US009054407B2

(12) United States Patent
Komura

(10) Patent No.: US 9,054,407 B2
(45) Date of Patent: Jun. 9, 2015

(54) ANTENNA DEVICE, ANTENNA MODULE, AND PORTABLE TERMINAL

(71) Applicant: MURATA MANUFACTURING CO., LTD., Kyoto-fu (JP)

(72) Inventor: Ryo Komura, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 178 days.

(21) Appl. No.: 13/762,277

(22) Filed: Feb. 7, 2013

(65) Prior Publication Data

US 2013/0147674 A1 Jun. 13, 2013

Related U.S. Application Data

(63) Continuation of application No. PCT/JP2011/079136, filed on Dec. 16, 2011.

(30) Foreign Application Priority Data

Dec. 21, 2010 (JP) ..... 2010-284214

(51) Int. Cl.
*H01Q 9/04* (2006.01)
*H01Q 3/24* (2006.01)
(Continued)

(52) U.S. Cl.
CPC ..... *H01Q 9/045* (2013.01); *H01Q 9/0457* (2013.01); *H01Q 3/247* (2013.01); *H01Q 1/38* (2013.01); *H01Q 1/243* (2013.01)

(58) Field of Classification Search
CPC ..... H01Q 1/243; H01Q 1/38; H01Q 3/24; H01Q 3/247; H01Q 5/01; H01Q 9/045; H01Q 9/0457; H01Q 1/50
USPC ..... 343/700 MS, 702, 749, 750, 876
See application file for complete search history.

(56) References Cited

U.S. PATENT DOCUMENTS 6,255,994 B1 7/2001 Saito
6,771,223 B1 8/2004 Shoji et al.
(Continued)

FOREIGN PATENT DOCUMENTS

CN 1437779 A 8/2003
CN 101436710 A 5/2009
(Continued)

OTHER PUBLICATIONS

The first Office Action issued by the State Intellectual Property Office of People's Republic of China on Mar. 19, 2014, which corresponds to Chinese Patent Application No. 201180039913.9 and is related to U.S. Appl. No. 13/762,277; with English language translation.
(Continued)

*Primary Examiner* — Robert Karacsony
(74) *Attorney, Agent, or Firm* — Studebaker & Brackett PC

(57) ABSTRACT

Radiation electrodes are formed on a dielectric base body of an antenna chip. A capacitive feeding electrode is formed on a first end surface of the dielectric base body. A ground electrode, a feeding circuit connection electrode, feeding lines, a tip electrode, and the like are formed on the top surface of a base member of a substrate. When a first switching element selects the feeding line side, a second switching element is made to enter a conducting state. In this state, the radiation electrodes are capacitively fed. When the first switching element selects the feeding line side, the second switching element is made to enter an open state. In this state, the radiation electrodes are directly fed. In this manner, the directivity direction of an antenna can be switched using a single radiation element.

10 Claims, 14 Drawing Sheets

(51) Int. Cl.
*H01Q 1/38* (2006.01)
*H01Q 1/24* (2006.01)

(56) References Cited

U.S. PATENT DOCUMENTS

| | | | | |
|---|---|---|---|---|
| 6,891,507 | B2 | 5/2005 | Kushihi et al. | |
| 7,777,688 | B2 | 8/2010 | Tani et al. | |
| 2005/0099347 | A1 | 5/2005 | Yamaki | |
| 2008/0143613 | A1 | 6/2008 | Iwai et al. | |
| 2009/0128428 | A1* | 5/2009 | Ishizuka et al. | 343/702 |
| 2011/0102290 | A1* | 5/2011 | Milosavljevic | 343/852 |

FOREIGN PATENT DOCUMENTS

| | | | |
|---|---|---|---|
| CN | 101809813 | A | 8/2010 |
| EP | 0993070 | A1 | 4/2000 |
| JP | 09-153734 | A | 6/1997 |
| JP | 11-112226 | A | 4/1999 |
| JP | 2001-326514 | A | 11/2001 |
| JP | 2004-165965 | A | 6/2004 |
| JP | 2005-020368 | A | 1/2005 |
| JP | 2006-174095 | A | 6/2006 |
| JP | 2008-118535 | A | 5/2008 |
| JP | 2008-167421 | A | 7/2008 |
| WO | 01/29927 | A1 | 4/2001 |
| WO | 02/39544 | A1 | 5/2002 |
| WO | WO2009/027579 | A1 * | 3/2009 ..... H01Q 1/24 |

OTHER PUBLICATIONS

International Search Report; PCT/JP2011/079136; Mar. 19, 2012.
Written Opinion of the International Searching Authority; PCT/JP2011/079136; Mar. 19, 2011.
The second Office Action issued by the State Intellectual Property Office of People's Republic of China on Nov. 4, 2014, which corresponds to Chinese Patent Application No. 201180039913.9 and is related to U.S. Appl. No. 13/762,277; with English language translation.

* cited by examiner (A)

(B)

(A)

(B)

(A)

(B)

(A)

(B)

ANTENNA DEVICE, ANTENNA MODULE, AND PORTABLE TERMINAL

CROSS REFERENCE TO RELATED APPLICATIONS

The present application is a continuation of International Application No. PCT/2011/079136 filed on Dec. 16, 2011, and claims priority to Japanese Patent Application No. 2010-284214 filed on Dec. 21, 2010, the entire contents of each of these applications being incorporated herein by reference in their entirety.

TECHNICAL FIELD

The technical field relates to antenna devices, and in particular to antenna devices whose antenna characteristics can be switched, and antenna modules and portable terminals that include the antenna device.

BACKGROUND

International Publication No. 2002/039544 (Patent Document 1) and Japanese Unexamined Patent Application Publication No. 9-153734 (Patent Document 2) disclose antenna devices whose antenna characteristics are changed by changing a method of feeding using a single antenna (radiation element). An antenna device disclosed in Patent Document 1 includes means for changing the direction of a current flowing through a substrate by changing the position of feeding, by controlling whether or not grounding is performed, or by controlling whether feeding or grounding is performed, through switching of one or a plurality of switches. Patent Document 1 relates to a surface mount antenna.

FIG. 1 is a perspective view of a surface mount antenna disclosed in Patent Document 2. A surface mount antenna 10 includes a base body 1. An end surface 1*a* of the base body 1 includes a ground terminal 2 and a feeding terminal 3 formed thereon in such a manner as to be divided from each other, and an end surface 1*b* includes a capacitive loading electrode 4 formed thereon. On the surface of the base body 1, a strip line radiation electrode 5 whose two ends are respectively connected to the ground terminal 2 and the capacitive loading electrode 4 is formed and a feeding electrode 6 that connects a matching portion 5*d* of the radiation electrode 5 to the feeding terminal 3 is formed.

SUMMARY

The present disclosure provides an antenna device in which a single radiation element is provided and a directivity direction of an antenna can be switched, and an antenna module and a mobile terminal that include the antenna device.

In one aspect of the present disclosure, an antenna device includes a radiation element including a direct feeding point, a capacitive feeding point, and a grounding point. A first switch is configured to switch between feeding from a feeding line to the direct feeding point of the radiation element and feeding from the feeding line to the capacitive feeding point of the radiation element. A second switch is configured to switch between electrically connecting and disconnecting the grounding point of the radiation element to and from the ground.

In another aspect of the disclosure, an antenna device includes a radiation element including a capacitive feeding point and a connection point that becomes a direct feeding point or a grounding point. A first switch is configured to switch between feeding from a feeding line to the direct feeding point of the radiation element and feeding from the feeding line to the capacitive feeding point of the radiation element. A second switch is configured to switch between electrically connecting and disconnecting the connection point of the radiation element to and from the ground.

Another aspect of the disclosure is an antenna device including a radiation element having a first connection point that becomes a direct feeding point or a grounding point (direct grounding point) and a second connection point that becomes a capacitive feeding point. A first switch is configured to switch between connecting the first connection point of the radiation element to a first feeding line and connecting the first connection point of the radiation element to the ground. A second switch is configured to switch between connecting and disconnecting the second connection point to and from a second feeding line.

In a more specific embodiment of any of the above configurations, at least one of the first switch and the second switch may be be formed of a p-intrinsic-n (PIN) diode or a metal semiconductor field effect transistor (MESFET).

In another more specific embodiment of any of the above configurations, an impedance matching circuit may be provided on the feeding line.

In yet another more specific embodiment of the above configuration, a third switch configured to switch connection of the impedance matching circuit to the feeding line may be further provided.

In still another more specific embodiment of the above configuration, the third switch may be formed of a PIN diode or a MESFET.

In another more specific embodiment of any of the above configurations, the radiation element may have a configuration in which a radiation electrode is formed on a dielectric or magnetic base body shaped like a rectangular parallelepiped.

Another more specific embodiment of the above configuration may include providing the first switch or the second switch on the base body.

In another aspect of the present disclosure, an antenna module may include the antenna device described in any one of the above configurations, wherein at least the radiation element, the first switch, the second switch, and the impedance matching circuit of the antenna device are formed on a single substrate, and wherein electrodes for mounting the antenna module on a board are formed on the substrate.

In another more specific embodiment, a mobile terminal may include the antenna device according to any one of the above-described antenna device configurations, or the above-described antenna module configuration, and a feeding circuit configured to feed the antenna device or the antenna module.

DETAILED DESCRIPTION

The antenna device disclosed in Patent Document 1 has a configuration in which the direction of a substrate current is changed by changing a feeding position and a grounding position using a switch. The inventor realized that because the structure of the antenna remains the same and the direction of a substrate current does not change considerably, it is assumed that the change may be limited to an extent that allows the directivity direction to be inclined only slightly, depending on the position of the antenna.

Additionally, the surface mount antenna disclosed in Patent Document 2 only allows selection, regarding a method of feeding, between direct feeding and capacitive feeding and, hence, the directivity does not change. The inventor also realized that to make the directivity be oriented in any direction, a plurality of antennas corresponding to respective directions need to be provided and switched among, which increases in mounting area and cost.

Figure 1:
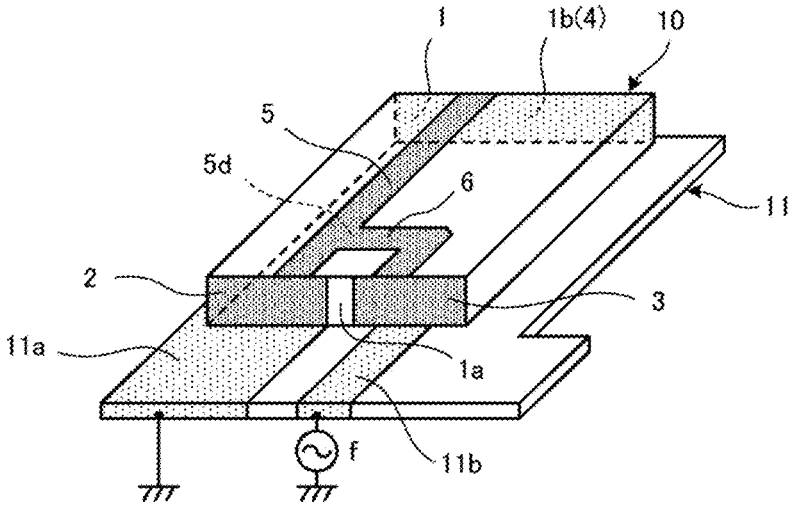
FIG.1 Prior Art
FIG. 1 is a perspective view of a surface mount antenna disclosed in Patent Document 2.
Figure 2:
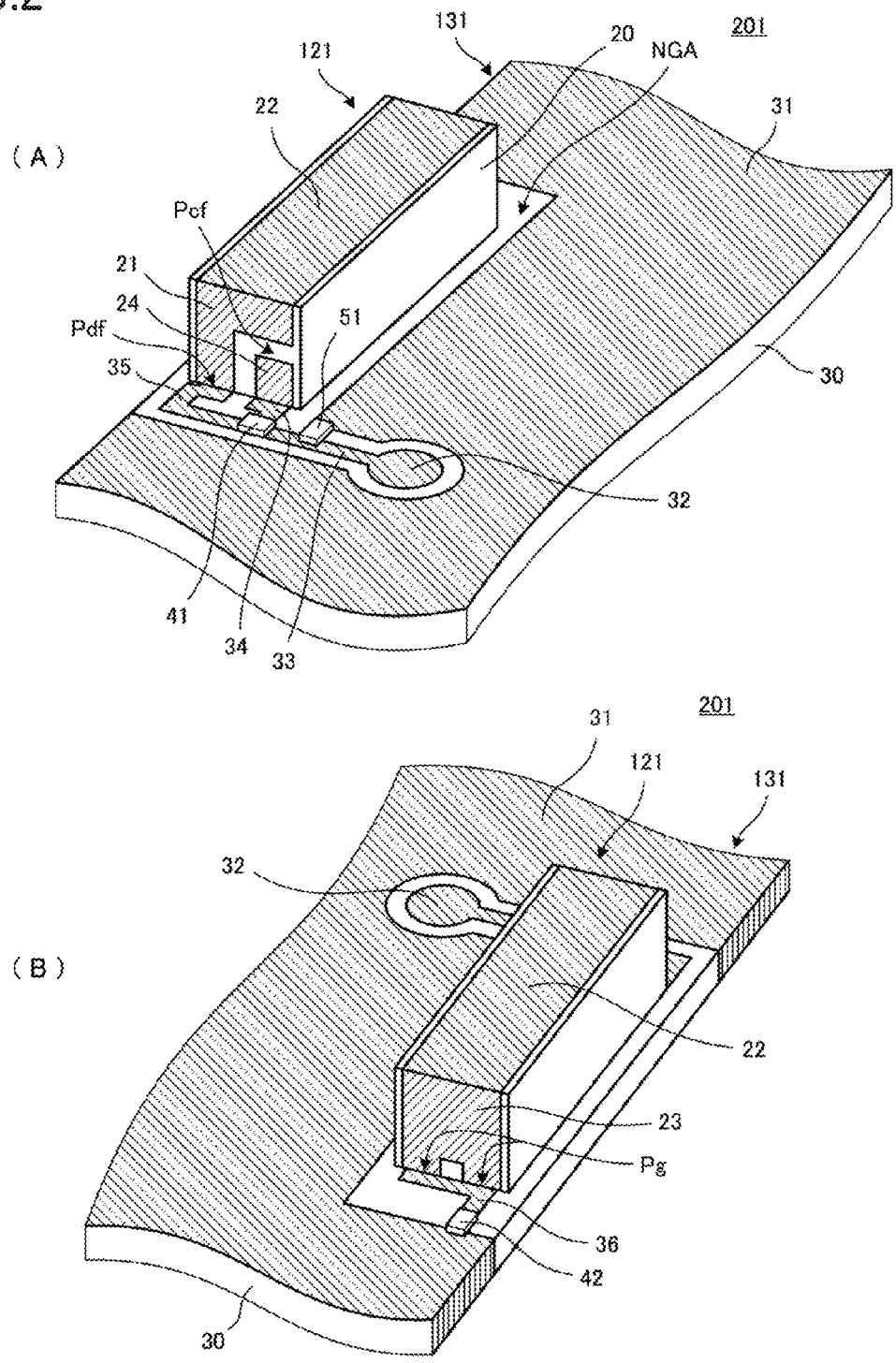
FIG. 2(A) and FIG. 2(B) are perspective views of the major portions of an antenna device 201 according to a first exemplary embodiment.

FIG. 2(A) and FIG. 2(B) are perspective views of the major portions of an antenna device 201 according to a first exemplary embodiment. FIG. 2(A) and FIG. 2(B) correspond to different viewpoints. The antenna device 201 is formed of a substrate 131 and an antenna chip 121 mounted on the substrate 131.

A radiation electrode 21, a radiation electrode 22, and a radiation electrode 23 are respectively formed on a first end surface, the top surface, and the second end surface of a dielectric base body 20 shaped like a rectangular parallelepiped. These radiation electrodes 21, 22, and 23 are continuous with one another. The first end surface of the dielectric base body 20 has a capacitive feeding electrode 24 formed thereon. On the bottom surface of the dielectric base body 20, mounting electrodes connected to the radiation electrodes 21 and 23 and the capacitive feeding electrode 24 are formed. The antenna chip 121 is formed of the above-described dielectric base body 20 and the various electrodes formed on the outer surfaces of the dielectric base body 20.

A ground electrode 31, a feeding circuit connection electrode 32, feeding lines 33, 34, and 35, a tip electrode 36, and the like are formed on the top surface of a base member 30. The base member 30 and the above-described various electrodes formed on the base member 30 form a substrate 131. The antenna chip 121 is mounted on a non-ground area NGA of the substrate 131, where the ground electrode is not formed.

The radiation electrode 21 is electrically connected to the feeding line 35, and the capacitive feeding electrode 24 is electrically connected to the feeding line 34. The radiation electrode 23 is electrically connected to the tip electrode 36.

A first switching element 41 is connected (i.e., mounted) between the feeding line 33 and the feeding lines 34 and 35. A second switching element 42 is connected (i.e., mounted) between the tip electrode 36 and the ground electrode 31. A matching circuit 51 is connected between a predetermined position of the feeding line 33 and the ground electrode 31.

The feeding circuit connection electrode 32, which is illustrated as a pattern shaped like a floating island so as to clearly illustrate the feeding line, is generally connected to a line (coplanar line) formed on the substrate 131. This is also true with other embodiments which follow.

The antenna chip 121 corresponds to an exemplary embedment of a "radiation element" according to Claims of the present invention. The lower end of the radiation electrode 21 is a direct feeding point Pdf. The opposing portion (i.e., capacitance forming portion) of the capacitive feeding electrode 24 and the radiation electrode 21 is a capacitive feeding point Pcf. The lower end of the radiation electrode 23 is a grounding point Pg.

Figure 3:
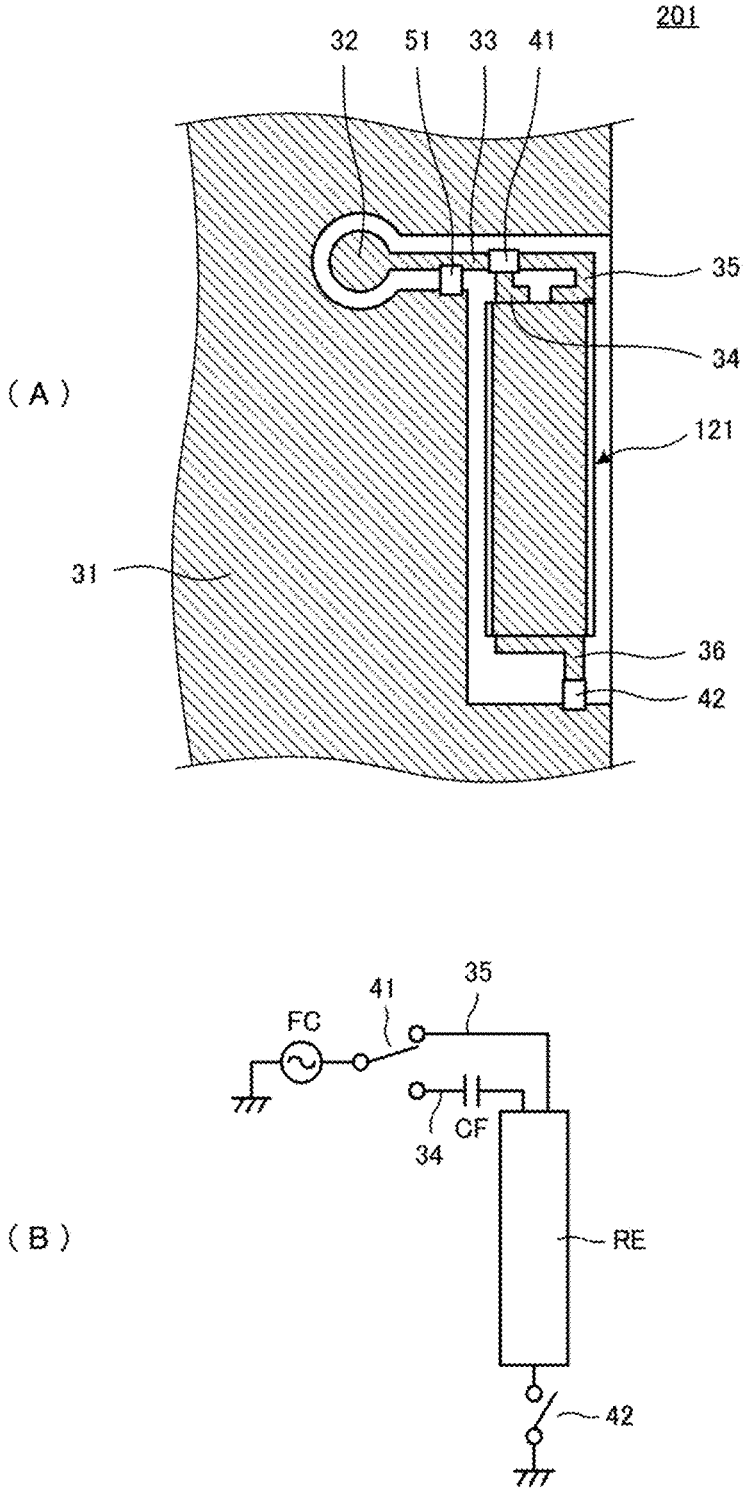
FIG. 3(A) is a plan view of the major portions of the antenna device 201.
FIG. 3(B) is an equivalent circuit diagram thereof.

FIG. 3(A) is a plan view of the major portions of the antenna device 201, and FIG. 3(B) is an equivalent circuit diagram thereof. The first switching element 41 illustrated in FIG. 3(A) selectively connects the feeding line 33 to one of the feeding lines 34 and 35. The second switching element 42 performs switching between grounding and disconnecting of the tip electrode 36 to ground. In FIG. 3(B), a radiation electrode RE corresponds to the radiation electrodes 21, 22, and 23. A feeding capacitance CF corresponds to a capacitance at the capacitive feeding point Pcf.

When the first switching element 41 illustrated in FIG. 3(A) and FIG. 3(B) selects the feeding line 34 side, the second switching element 42 is made to enter a conducting state. In this state, the radiation electrode RE is capacitively fed. On the other hand, when the first switching element 41 selects the feeding line 35 side, the second switching element 42 is made to enter an open state. In this state, the radiation electrode RE is directly fed.

Note that each of the first switching element 41 and the second switching element 42 can be formed of a p-intrinsic diode (PIN diode) or a metal semiconductor field effect transistor (MESFET), for example. Since these switching elements are small, space occupied by the antenna is reduced. Further, since their switching speed is high, the antenna operation can be instantly switched. When high speed switching is not required, micro electro-mechanical systems (MEMS) devices may be used. Control signals for these switching devices are provided from a control circuit (not shown) formed on the substrate 131. These are also true with other embodiments which follow.

Figure 4:
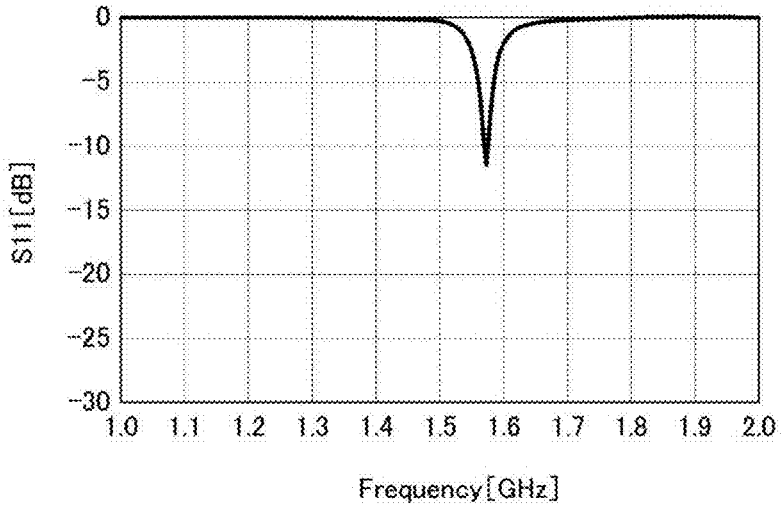
FIG. 4(A) illustrates return-loss characteristics during a direct feeding operation.
FIG. 4(B) illustrates return-loss characteristics during a capacitive feeding operation.
Figure 4:
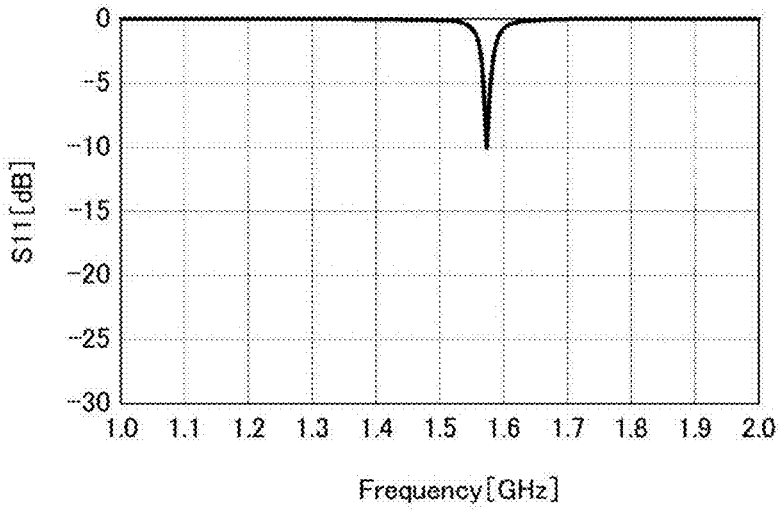

FIG. 4(A) illustrates return-loss characteristics during a direct feeding operation, and FIG. 4(B) illustrates return-loss characteristics during a capacitive feeding operation. Here, the resonant frequency of the radiation electrode of the antenna chip 121 is a frequency in the 1.5 GHz band. It can be seen that the return loss is −10 dB or less at the same frequency in the frequency band used and that sufficient return loss characteristics are obtained, for either of the feeding operations.

Figure 5:
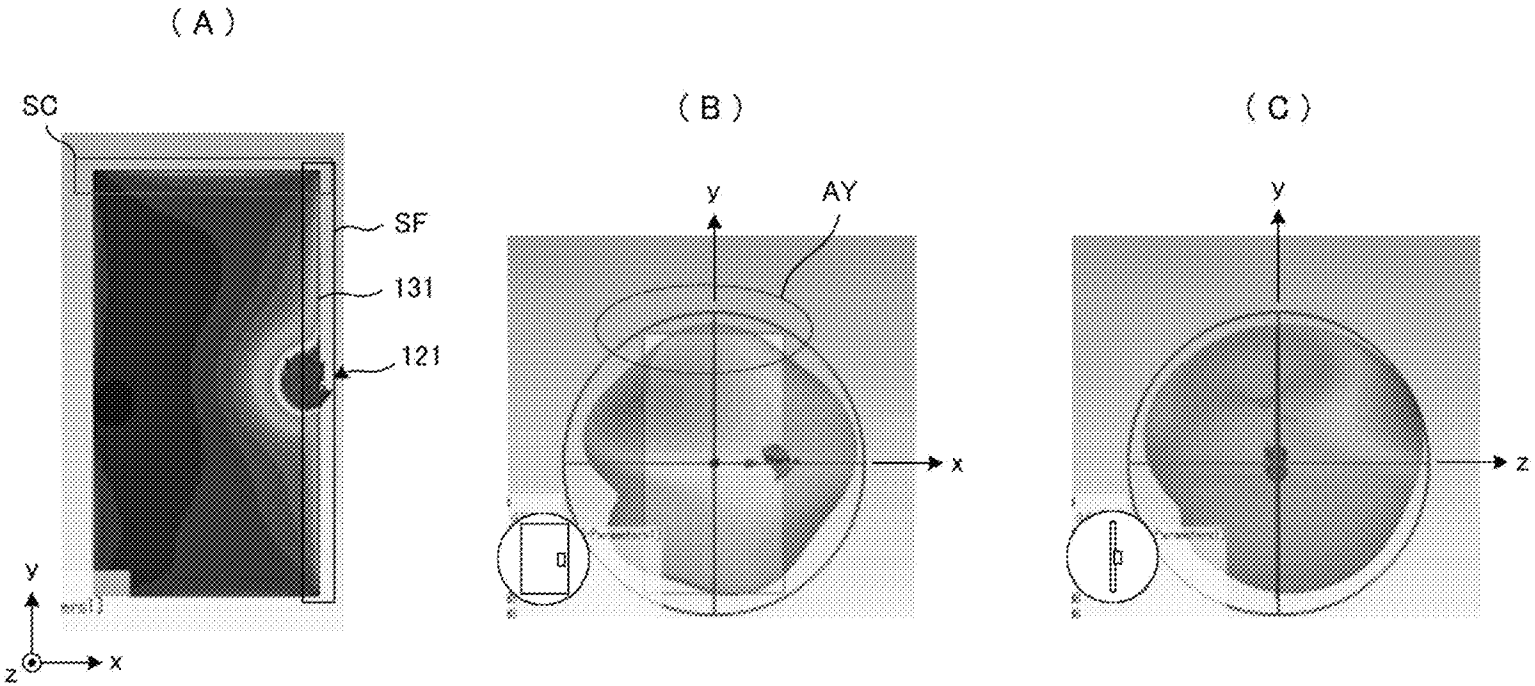
FIG. 5 includes diagrams illustrating the current distribution of a substrate and directivity for a direct feeding operation.
Figure 6:
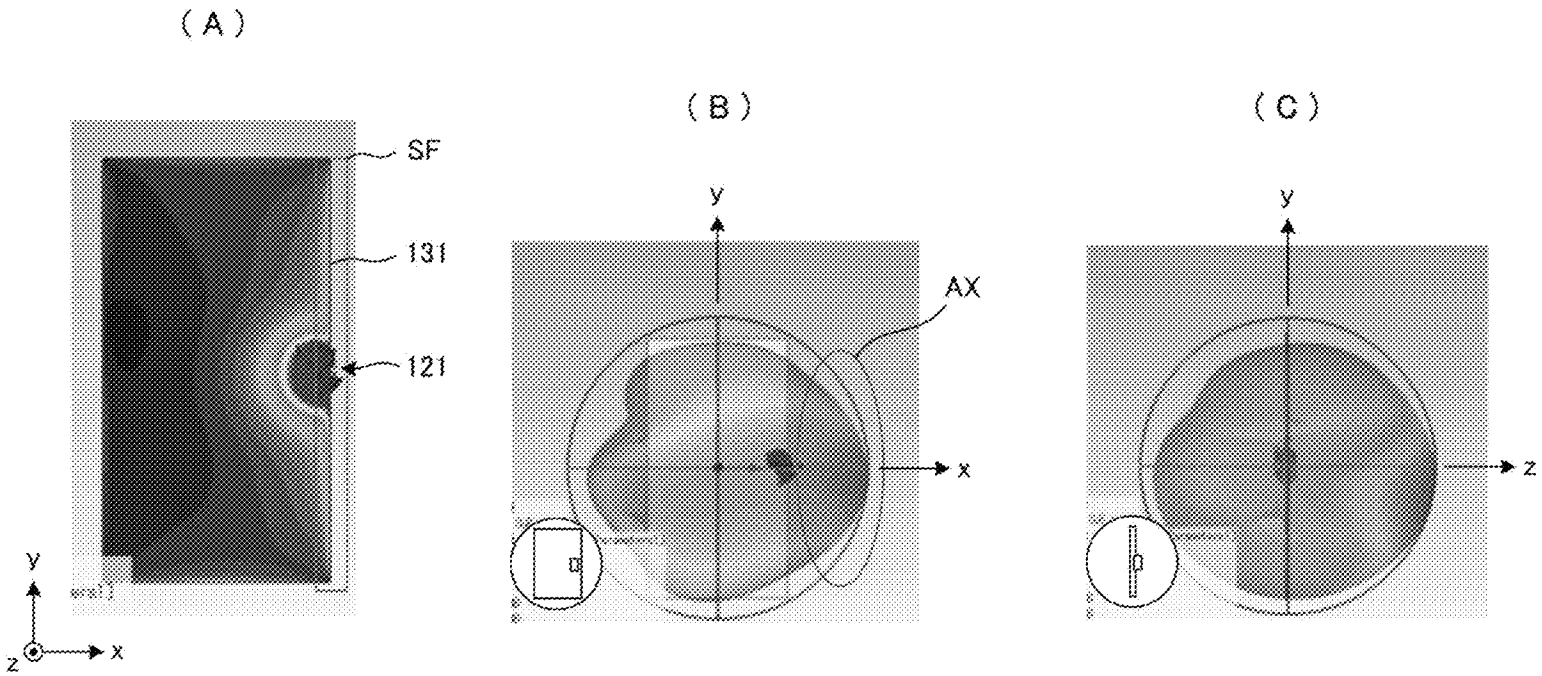
FIG. 6 includes diagrams illustrating the current distribution of a substrate and directivity for a capacitive feeding operation.

FIG. 5 includes diagrams illustrating the current distribution of the substrate and directivity for the direct feeding operation, and FIG. 6 includes diagrams illustrating the current distribution of the substrate and directivity for the capacitive feeding operation. FIG. 5(A) and FIG. 6(A) are diagrams illustrating the intensity distribution of a current flowing through the ground electrode 31 of the substrate 131 (density distribution of a substrate current), where the higher the current density, the darker the shading of the illustration. The substrate is arranged on the xy-plane and the mounting position of the antenna chip 121 is biased toward the x-axis direction with respect to the substrate. In this example, the antenna chip 121 is mounted near a position in the center of a long side of the substrate 131.

FIG. 5(B) and FIG. 6(B) illustrate the directivity in the xy-plane (i.e., a surface direction of the substrate), and FIG. 5(C) and FIG. 6(C) illustrate the directivity in the yz-plane (i.e., a plane perpendicular to the substrate). In either case, the higher the radiation efficiency, the darker the shading of the illustration.

As is clear from the comparison of FIG. 5(A) and FIG. 6(A), the current density of the substrate in the direct feeding operation is different from that in the capacitive feeding operation. Although the current density at a side SF of the substrate 131 where the antenna chip 121 is mounted is high in both the direct feeding operation and capacitive feeding operation, there is a tendency that the current density at a side SC perpendicular to the side SF where the antenna chip 121 is mounted also becomes high in the direct feeding operation. In the capacitive feeding operation, a current is widely distributed at the side SF of the substrate 131 along the mounting position of the antenna chip 121.

It is well known that the directivity of an antenna is oriented in the direction of a side with a higher substrate current density. Hence, the directivity is oriented in the x direction in the direct operation, and oriented in the y direction in the capacitive operation. This is also clear from the directivity diagrams illustrated in FIG. 5(B), FIG. 5(C), FIG. 6(B), and FIG. 6(C). In other words, in the direct feeding operation, the direction of high radiation electric field intensity is approximately oriented in the y-axis direction as illustrated in FIG. 5(B) and FIG. 5(C). In the capacitive feeding operation, the direction of high radiation electric field intensity is approximately oriented in the x-axis direction as illustrated in FIG. 6(B) and FIG. 6(C).

Since switching between the direct feeding operation and the capacitive feeding operation is performed by switching of the first switching element 41 and the second switching element 42, the directivity of the antenna device 201 can be switched by switching of the first switching element 41 and the second switching element 42.

Figure 7:
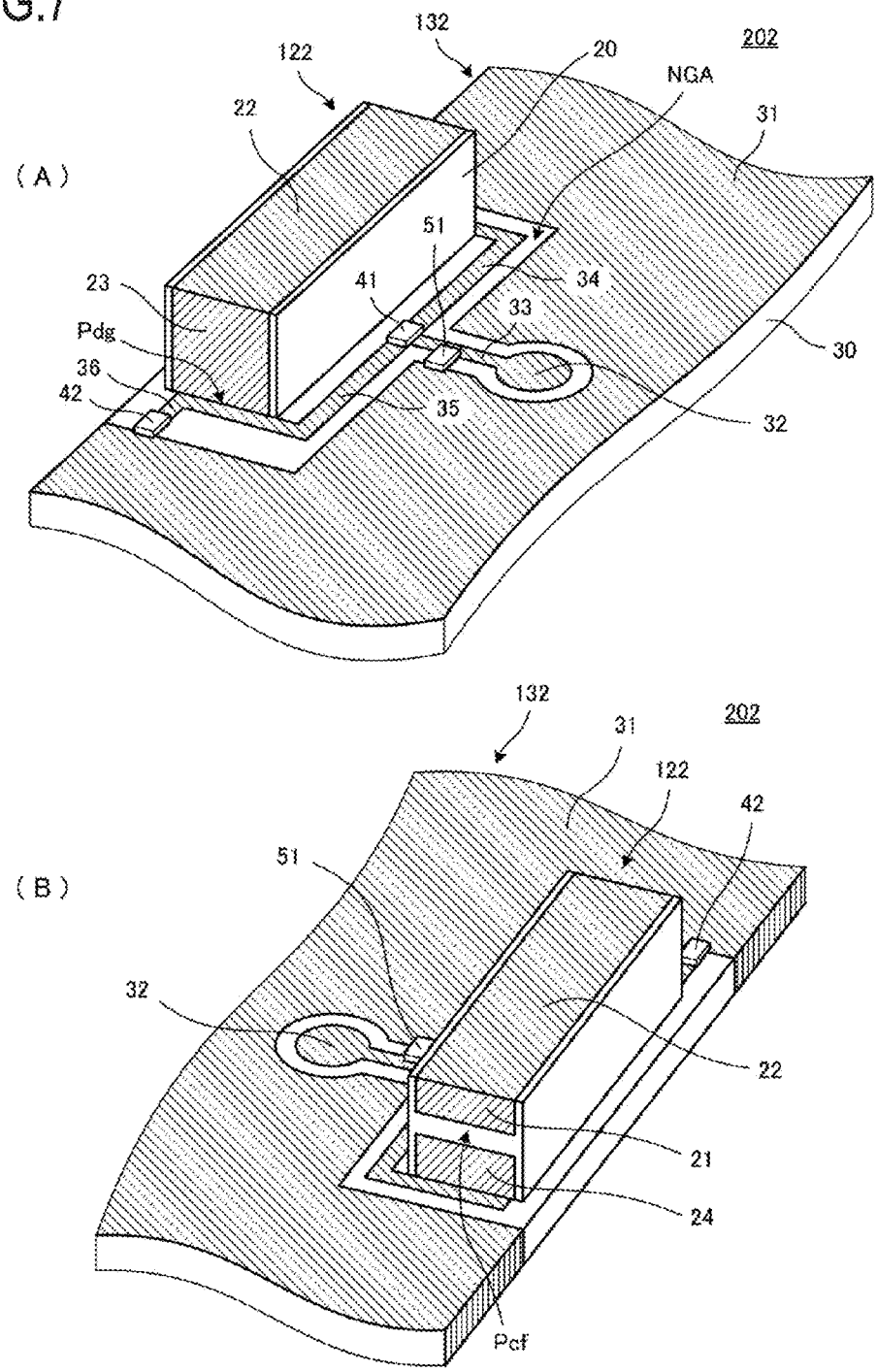
FIG. 7(A) and FIG. 7(B) are perspective views of the major portions of an antenna device 202 according to a second exemplary embodiment.

FIG. 7(A) and FIG. 7(B) are perspective views of the major portions of an antenna device 202 according to a second exemplary embodiment. FIG. 7(A) and FIG. 7(B) correspond to different viewpoints. The antenna device 202 is formed of a substrate 132 and an antenna chip 122 mounted on the substrate 132.

A radiation electrode 21, a radiation electrode 22, and a radiation electrode 23 are respectively formed on a first end surface, the top surface, and the second end surface of a dielectric base body 20 shaped like a rectangular parallelepiped. These radiation electrodes 21, 22, and 23 are continuous with one another. The first end surface of the dielectric base body 20 has a capacitive feeding electrode 24 formed thereon. On the bottom surface of the dielectric base body 20, mounting electrodes connected to the radiation electrode 23 and the capacitive feeding electrode 24 are formed. The antenna chip 122 is formed of the above-described dielectric base body 20 and the various electrodes formed on the outer surfaces of the dielectric base body 20.

A ground electrode 31, a feeding circuit connection electrode 32, feeding lines 33, 34, and 35, a tip electrode 36, and the like are formed on the top surface of a base member 30. The base member 30 and the above-described various electrodes formed on the base member 30 form a substrate 132. The antenna chip 122 is mounted on a non-ground area NGA of the substrate 132, where the ground electrode is not formed.

The radiation electrode 23 is electrically connected to the feeding line 35, and the capacitive feeding electrode 24 is electrically connected to the feeding line 34. The radiation electrode 23 is electrically connected to the tip electrode 36.

A first switching element 41 is connected (i.e., mounted) between the feeding line 33 and the feeding lines 34 and 35. A second switching element 42 is connected (i.e., mounted) between the tip electrode 36 and the ground electrode 31. A matching circuit 51 is connected between a predetermined position of the feeding line 33 and the ground electrode 31.

The antenna chip 122 corresponds to an example of a "radiation element" according to Claims of the present invention. The opposing portion (i.e., capacitance forming portion) of the capacitive feeding electrode 24 and the radiation electrode 21 is a capacitive feeding point Pcf. The lower end of the radiation electrode 23 is a connection point Pdg, which becomes a direct feeding point or a grounding point.

Figure 8:
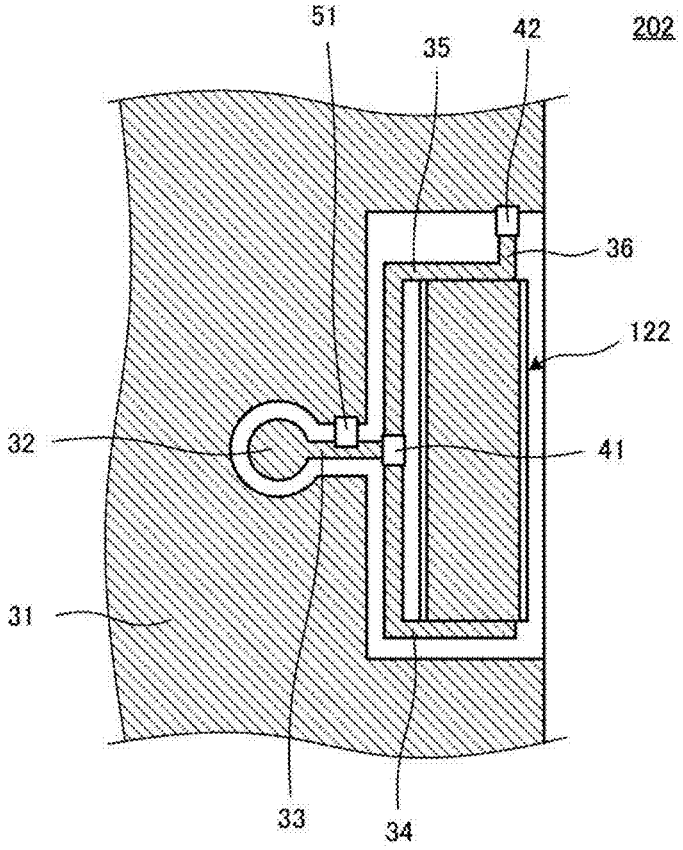
FIG. 8(A) is a plan view of the major portions of the antenna device 202.
FIG. 8(B) is an equivalent circuit diagram thereof.
Figure 8:
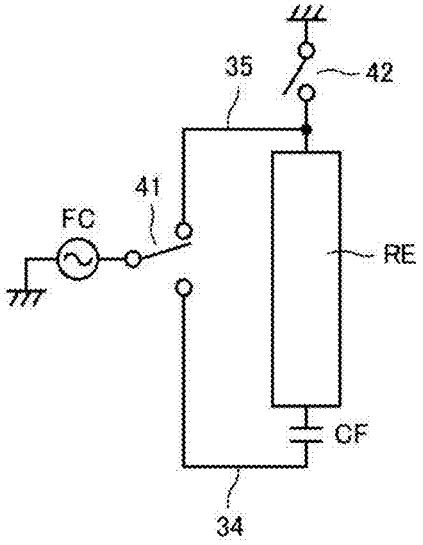

FIG. 8(A) is a plan view of the major portions of the antenna device 202, and FIG. 8(B) is an equivalent circuit diagram thereof. The first switching element 41 illustrated in FIG. 8(A) selectively connects the feeding line 33 to one of the feeding lines 34 and 35. The second switching element 42 performs switching between grounding and disconnecting of the tip electrode 36. In FIG. 8(B), a radiation electrode RE corresponds to the radiation electrodes 21, 22, and 23. A feeding capacitance CF corresponds to a capacitance at the capacitive feeding point.

When the first switching element 41 illustrated in FIG. 8(A) and FIG. 8(B) selects the feeding line 34 side, the second switching element 42 is made to enter a conducting state. In this state, the radiation electrode RE is capacitively fed. On the other hand, when the first switching element 41 selects the feeding line 35 side, the second switching element 42 is made to enter an open state. In this state, the radiation electrode RE is directly fed.

As described in the first exemplary embodiment, since switching between the direct feeding operation and the capacitive feeding operation is performed by switching of the first switching element 41 and the second switching element 42, the directivity of the antenna device 202 can be switched by switching of the first switching element 41 and the second switching element 42.

Figure 9:
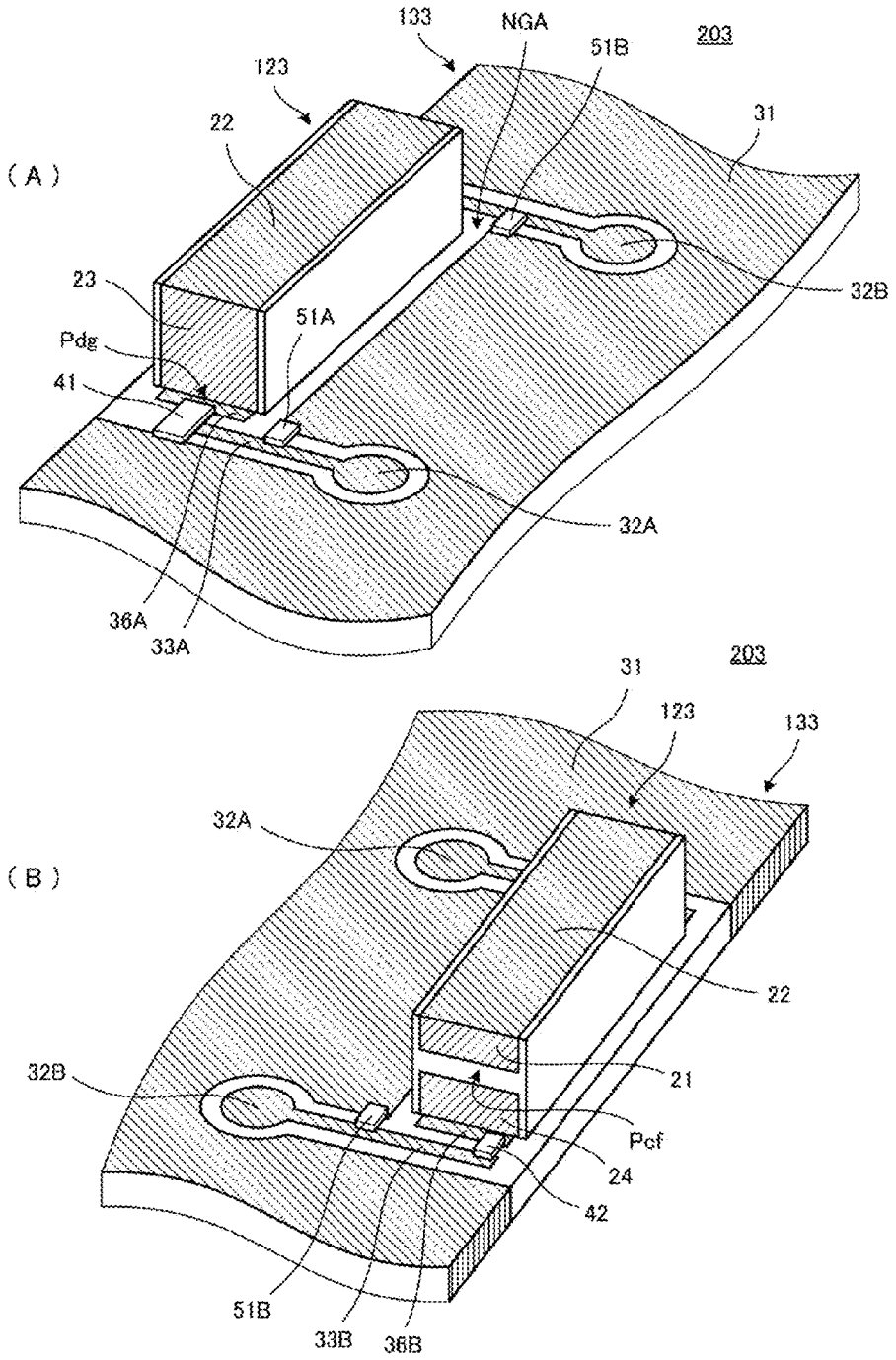
FIG. 9(A) and FIG. 9(B) are perspective views of the major portions of an antenna device 203 according to a third exemplary embodiment.

FIG. 9(A) and FIG. 9(B) are perspective views of the major portions of an antenna device 203 according to a third exemplary embodiment. FIG. 9(A) and FIG. 9(B) correspond to different viewpoints. The antenna device 203 is formed of a substrate 133 and an antenna chip 123 mounted on the substrate 133.

A radiation electrode 21, a radiation electrode 22, and a radiation electrode 23 are respectively formed on a first end surface, the top surface, and the second end surface of a dielectric base body 20 shaped like a rectangular parallelepiped. These radiation electrodes 21, 22, and 23 are continuous with one another. The first end surface of the dielectric base body 20 has a capacitive feeding electrode 24 formed thereon. On the bottom surface of the dielectric base body 20, mounting electrodes connected to the radiation electrode 23 and the capacitive feeding electrode 24 are formed. The antenna chip 123 is formed of the above-described dielectric base body 20 and the various electrodes formed on the outer surfaces of the dielectric base body 20.

A ground electrode 31, feeding circuit connection electrodes 32A and 32B, feeding lines 33A and 33B, tip electrodes 36A and 36B, and the like are formed on the top surface of a base member 30. The base member 30 and the above-described various electrodes formed on the base member 30 form a substrate 133. The antenna chip 123 is mounted on a non-ground area NGA of the substrate 133, where the ground electrode is not formed.

The radiation electrode 23 is electrically connected to the tip electrode 36A, and the capacitive feeding electrode 24 is electrically connected to the tip electrode 36B.

A first switching element 41 is connected (i.e., mounted) to the tip electrode 36A, the feeding line 33A and the ground electrode 31. A second switching element 42 is connected (i.e., mounted) between the feeding line 33B and the tip electrode 36B. Matching circuits 51A and 51B are respectively connected between the ground electrode 31 and predetermined positions of the feeding lines 33A and 33B.

The antenna chip 123 corresponds to an exemplary "radiation element" according to Claims of the present invention. The opposing portion (i.e., capacitance forming portion) of the capacitive feeding electrode 24 and the radiation electrode 21 is a capacitive feeding point Pcf. The lower end of the radiation electrode 23 is a connection point Pdg, which becomes a direct feeding point or a grounding point.

Figure 10:
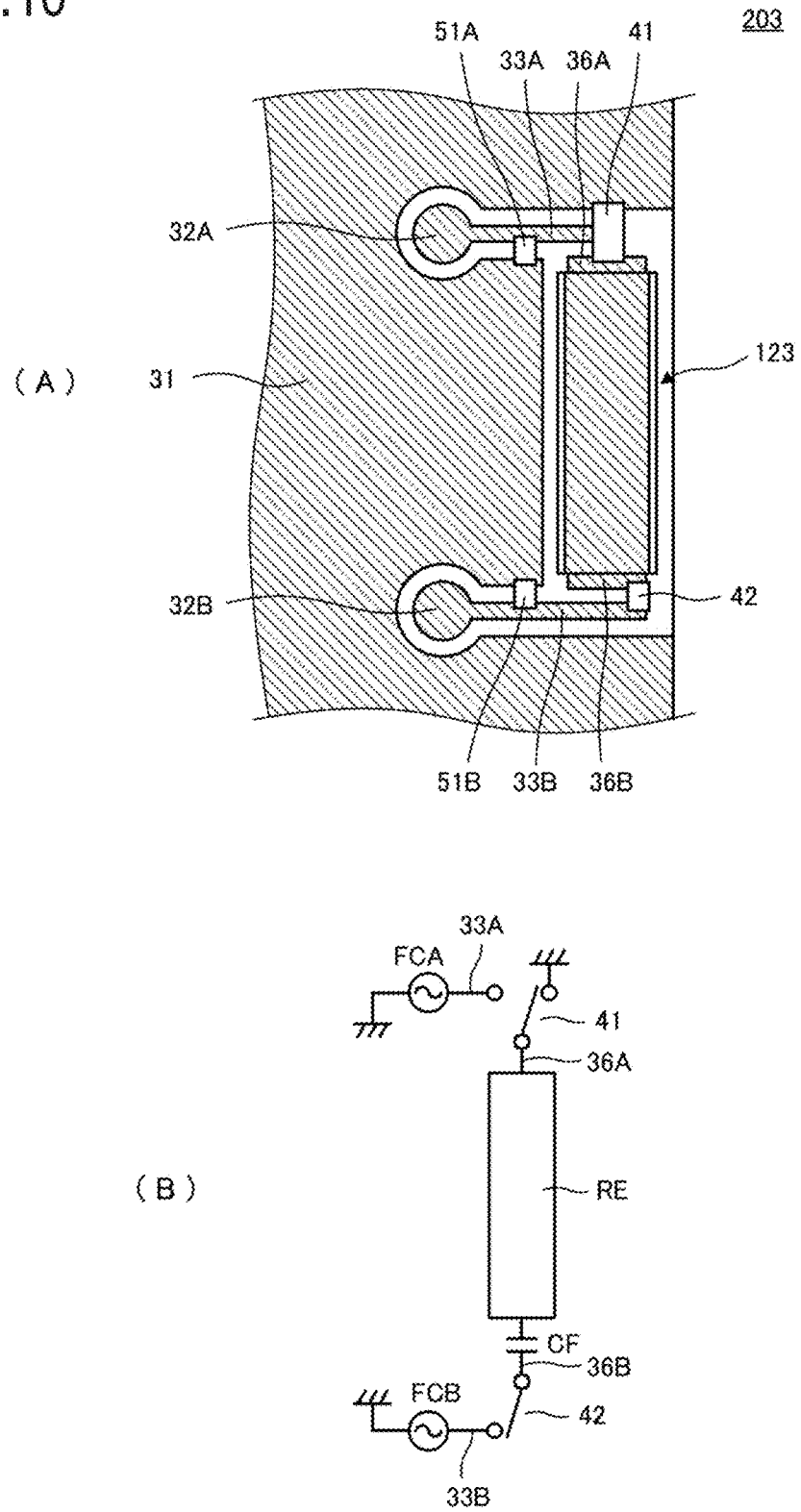
FIG. 10(A) is a plan view of the major portions of the antenna device 203.
FIG. 10(B) is an equivalent circuit diagram thereof.

FIG. 10(A) is a plan view of the major portions of the antenna device 203, and FIG. 10(B) is an equivalent circuit diagram thereof. The first switching element 41 illustrated in FIG. 10(A) selectively connects the tip electrode 36A to one of the feeding line 33A and the ground electrode. The second switching element 42 performs switching between connecting and disconnecting the tip electrode 36B to and from the feeding line 33B. In FIG. 10(B), a radiation electrode RE corresponds to the radiation electrodes 21, 22, and 23. A feeding capacitance CF corresponds to a capacitance at the capacitive feeding point.

When the first switching element 41 illustrated in FIG. 10(A) and FIG. 10(B) selects the feeding line 33A side, the second switching element 42 is made to enter an open state. In this state, the radiation electrode RE is directly fed. On the other hand, when the first switching element 41 selects the grounding electrode side, the second switching element 42 selects the feeding line 33B side. In this state, the radiation electrode RE is capacitively fed.

As described in the first embodiment, since switching between the direct feeding operation and the capacitive feeding operation is performed by switching of the first switching element 41 and the second switching element 42, the directivity of the antenna device 201 can be switched by switching of the first switching element 41 and the second switching element 42. In addition, since feeding from two feeding circuits can be switched between by switching of the first switching element 41 and the second switching element 42, a direct feeding operation and a capacitive feeding operation can be performed by separate feeding circuits.

Figure 11:
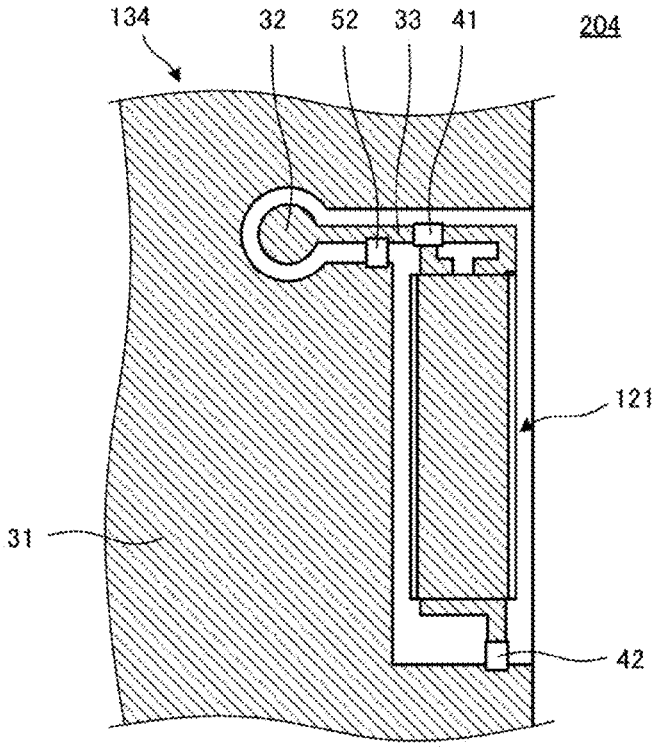
FIG. 11(A) is a plan view of the major portions of an antenna device 204 according to a fourth embodiment.
FIG. 11(B) is an equivalent circuit diagram thereof.
Figure 11:
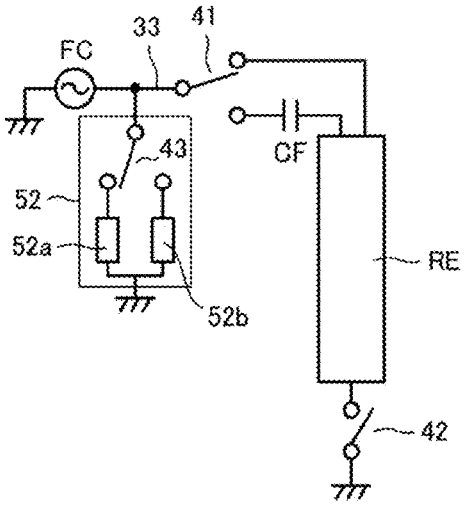

FIG. 11(A) is a plan view of the major portions of an antenna device 204 according to a fourth exemplary embodiment, and FIG. 11(B) is an equivalent circuit diagram thereof. The antenna device 204 is formed of a substrate 134 and an antenna chip 121 mounted on the substrate 134. The antenna chip 121 is the same as the antenna chip described in the first exemplary embodiment. A switchable matching circuit 52 is connected between a predetermined position of a feeding line 33 provided on the substrate 134 and a ground electrode 31.

Referring to FIG. 11(B), the switchable matching circuit 52 includes a plurality (two in this example) of matching circuit elements 52*a* and 52*b* and a third switching element 43. One of the matching circuit elements 52*a* and 52*b* is connected between the feeding line 33 and the ground through switching of the third switching element 43. The matching circuit element 52*a* or 52*b* is selected in accordance with direct feeding or capacitive feeding for a radiation electrode RE. In other words, switching of the third switching element 43 is interlocked with switching of the first switching element 41 and the second switching element 42.

Figure 12:
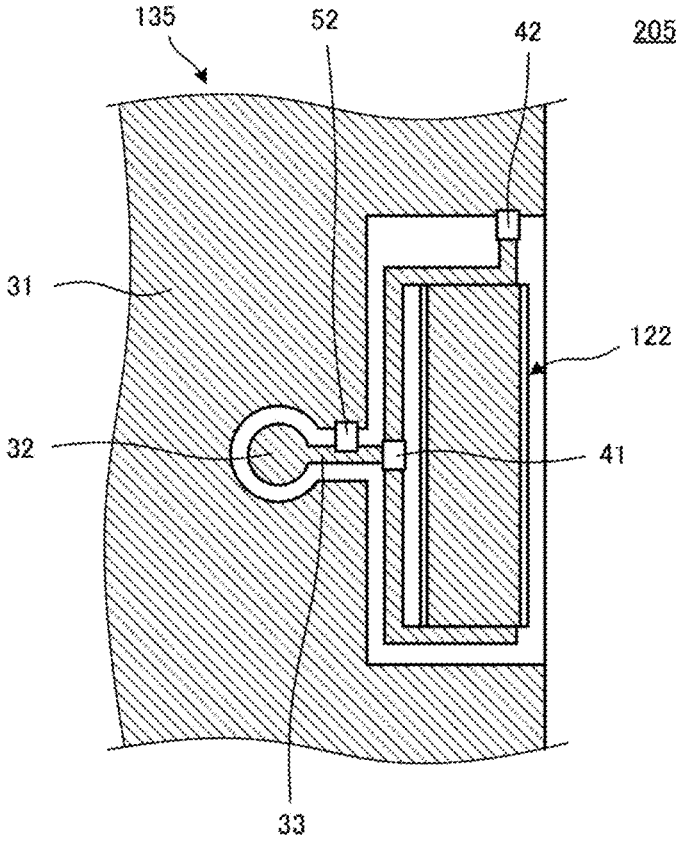
FIG. 12(A) is a plan view of the major portions of an antenna device 205 according to a fifth exemplary embodiment.
FIG. 12(B) is an equivalent circuit diagram thereof.
Figure 12:
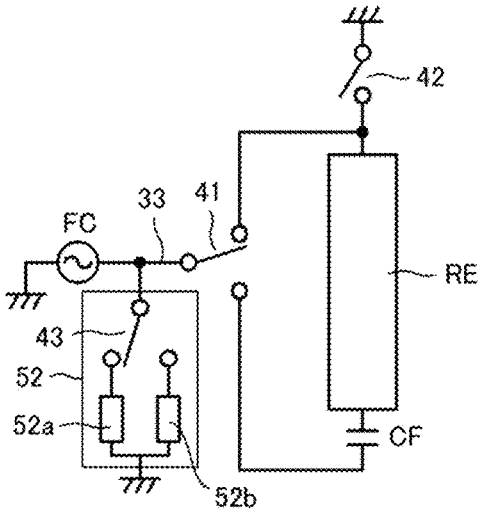

FIG. 12(A) is a plan view of the major portions of an antenna device 205 according to a fifth exemplary embodiment, and FIG. 12(B) is an equivalent circuit diagram thereof. The antenna device 205 is formed of a substrate 135 and an antenna chip 122 mounted on the substrate 135. The antenna chip 122 is the same as the antenna chip described in the second exemplary embodiment. A switchable matching circuit 52 is connected between a predetermined position of a feeding line 33 provided on the substrate 135 and a ground electrode 31.

Referring to FIG. 12(B), the switchable matching circuit 52 includes matching circuit elements 52*a* and 52*b* and a third switching element 43. Similarly to the fourth embodiment, one of the matching circuit elements 52*a* and 52*b* is connected between the feeding line 33 and the ground through switching of the third switching element 43. The matching circuit element 52*a* or 52*b* is selected in accordance with direct feeding or capacitive feeding for a radiation electrode RE. In other words, switching of the third switching element 43 is interlocked with switching of the first switching element 41 and the second switching element 42.

Figure 13:
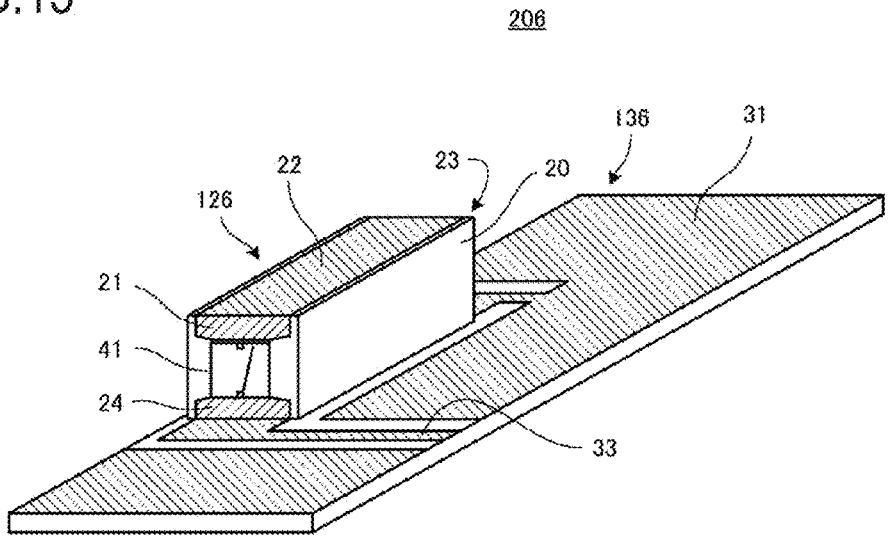
FIG. 13 is a perspective view of the major portions of an antenna device 206 according to a sixth exemplary embodiment.

FIG. 13 is a perspective view of the major portions of an antenna device 206 according to a sixth exemplary embodiment. The antenna device 206 is formed of a substrate 136 and an antenna chip 126 mounted on the substrate 136.

A radiation electrode 21, a radiation electrode 22, and a radiation electrode 23 (hidden on the back surface in FIG. 13) are respectively formed on a first end surface, the top surface, and the second end surface of a dielectric base body 20 shaped like a rectangular parallelepiped. These radiation electrodes 21, 22, and 23 are continuous with one another.

On the first end surface of the dielectric base body 20, a capacitive feeding electrode 24 is formed and, further, a first switching element 41 is provided between the capacitive feeding electrode 24 and the radiation electrode 21. On the second end surface of the dielectric base body 20, an electrode connected to a ground electrode 31 of the substrate is formed and, further, a second switching element is connected between this electrode and the radiation electrode 23.

Note that a switch symbol is illustrated in the first switching element 41 portion in FIG. 13.

Figure 14:
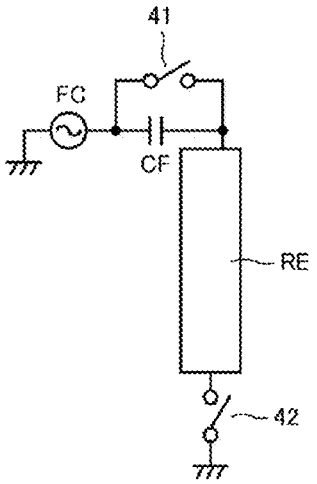
FIG. 14 is an equivalent circuit of the antenna device 206.

FIG. 14 is an equivalent circuit of the antenna device 206. Referring to FIG. 14, a radiation electrode RE corresponds to the radiation electrodes 21, 22, and 23. A feeding capacitance CF corresponds to a capacitance at the capacitive feeding point. The first switching element 41 switches the states of the two ends of the feeding capacitance CF between a connected state and a disconnected state. The second switching element 42 performs switching between grounding and disconnecting of the tip of the radiation electrode 23.

When the first switching element 41 illustrated in FIG. 13 and FIG. 14 conducts, the second switching element 42 is made to enter an open state. In this state, the radiation electrode RE is directly fed. On the other hand, when the first switching element 41 is made to be open, the second switching element 42 is made to enter a conducting state. In this state, the radiation electrode RE is capacitively fed.

Since the first switching element 41 and the second switching element 42 are provided in an antenna chip 126, the number of components mounted on a substrate 136 is reduced, whereby simplification is realized overall. Further, a space of the substrate occupied by the antenna is reduced.

Figure 15:
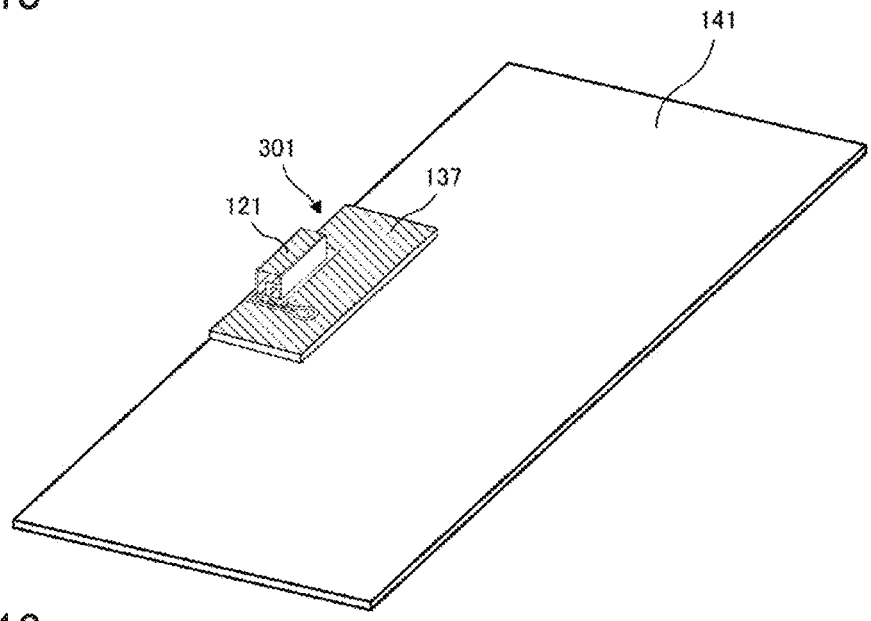
FIG. 15 is a perspective view of an antenna module 301 according to a seventh exemplary embodiment and the antenna module 301 in a mounted state.

FIG. 15 is a perspective view of an antenna module 301 according to a seventh exemplary embodiment and the antenna module 301 in a mounted state. The antenna module 301 has a configuration in which the antenna device described in the first embodiment is formed on a module substrate 137. Electrodes for mounting the antenna module 301 on a substrate 141 are formed on the bottom surface of the module substrate 137. The antenna device is formed by mounting the antenna module 301 on the substrate 141.

By making an antenna device be a single component in the form of a modular structure, it becomes easy to determine the characteristics of the antenna.

Figure 16:
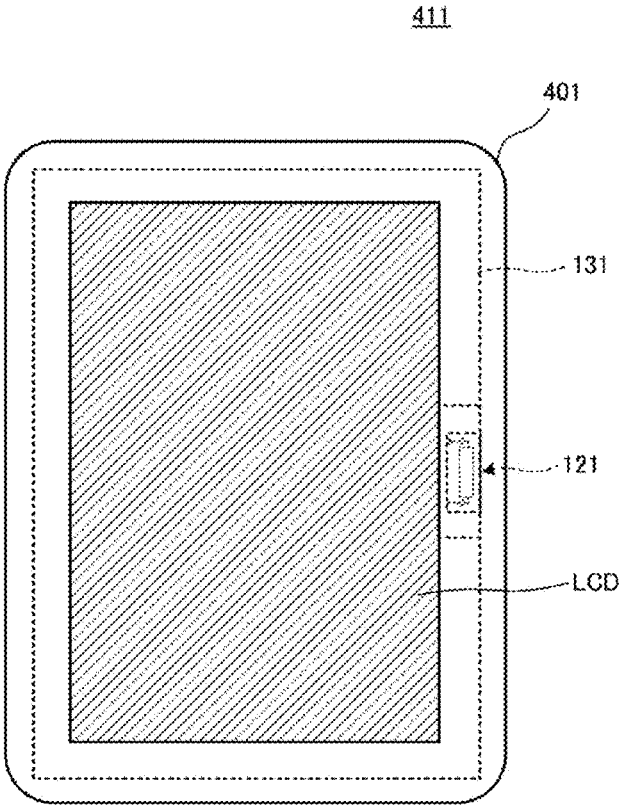
FIG. 16 is a plan view of a portable terminal according to an eighth exemplary embodiment.

FIG. 16 is a plan view of a portable terminal according to an eighth exemplary embodiment. In a portable terminal 411, a liquid crystal display panel LCD is provided on the front surface of a casing 401. A substrate 131 is provided within the casing 401, and an antenna chip 121 is mounted on the substrate 131. The substrate 131 and the antenna chip 121 form the antenna device described in the first embodiment. A communication circuit that includes a feeding circuit for the antenna device is formed on the substrate 131.

Although an antenna chip is formed by forming various electrodes on the dielectric base body 20 in the embodiments described above, an antenna chip may be formed by forming various electrodes on a magnetic base body. In either of the cases, since electrodes can be designed to have short lengths due to the wavelength reduction effect, the antenna can be reduced in size.

In embodiments according to the present disclosure, the directivity direction of an antenna can be switched using a single radiation element, and the directivity of the antenna can be optimized as required.

That which is claimed is:

1. An antenna device comprising:

a radiation element including a capacitive feeding point and a connection point that becomes a direct feeding point or a grounding point;

a first switch configured to switch between feeding from a feeding line to the direct feeding point of the radiation element and feeding from the feeding line to the capacitive feeding point of the radiation element; and a second switch configured to switch between electrically connecting and disconnecting the connection point of the radiation element to and from ground.

2. The antenna device according to claim 1, wherein at least one of the first switch and the second switch is formed of a PIN diode or a MESFET.

3. The antenna device according to claim 1, wherein an impedance matching circuit is provided on the feeding line.

4. The antenna device according to claim 1, wherein the radiation element has a configuration in which a radiation electrode is formed on a dielectric or magnetic base body shaped like a rectangular parallelepiped.

5. A mobile terminal comprising:

the antenna device according to claim 1; and a feeding circuit configured to feed the antenna device or the antenna module.

6. An antenna device comprising:

a radiation element including a first connection point that becomes a direct feeding point or a grounding point and a second connection point that becomes a capacitive feeding point;

a first switch configured to switch between connecting the first connection point of the radiation element to a first feeding line and connecting the first connection point of the radiation element to ground; and a second switch configured to switch between connecting and disconnecting the second connection point to and from a second feeding line.

7. The antenna device according to claim 6, wherein at least one of the first switch and the second switch is formed of a PIN diode or a MESFET.

8. The antenna device according to claim 6, wherein an impedance matching circuit is provided on the feeding line.

9. The antenna device according to claim 6, wherein the radiation element has a configuration in which a radiation electrode is formed on a dielectric or magnetic base body shaped like a rectangular parallelepiped.

10. A mobile terminal comprising:

the antenna device according to claim 6; and a feeding circuit configured to feed the antenna device or the antenna module.

* * * * *